US007690928B2

(12) United States Patent
Lappoehn

(10) Patent No.: US 7,690,928 B2
(45) Date of Patent: Apr. 6, 2010

(54) PLUG-IN CONNECTOR

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 12/217,155

(22) Filed: Jul. 2, 2008

(65) Prior Publication Data

US 2009/0011622 A1 Jan. 8, 2009

(30) Foreign Application Priority Data

Jul. 3, 2007 (DE) ..... 10 2007 030 920

(51) Int. Cl.
*H01R 12/00* (2006.01)

(52) U.S. Cl. ..... 439/75

(58) Field of Classification Search ..... 439/75, 439/607, 79–80, 660, 607.01, 78, 222, 654
See application file for complete search history.

(56) References Cited

U.S. PATENT DOCUMENTS

| | | | | |
|---|---|---|---|---|
| 5,188,535 | A | 2/1993 | Bertho et al. | |
| 5,556,285 | A | 9/1996 | Ono | |
| 5,902,136 | A | 5/1999 | Lemke et al. | |
| 6,030,241 | A * | 2/2000 | Chiba | 439/222 |
| 6,039,590 | A | 3/2000 | Kunishi | |
| 6,048,482 | A | 4/2000 | Lemke et al. | |
| 6,065,951 | A | 5/2000 | Lemke et al. | |
| 7,108,520 | B1 * | 9/2006 | Delaney et al. | 439/79 |
| 7,121,885 | B2 * | 10/2006 | Li et al. | 439/607 |
| 7,131,849 | B2 | 11/2006 | Nishimura et al. | |

FOREIGN PATENT DOCUMENTS

| | | |
|---|---|---|
| DE | 697 08 526 | 6/2002 |
| DE | 10 2005 028 512 | 3/2006 |

OTHER PUBLICATIONS

Catalogue No. D 074570, (Feb. 2007), Edition 1. (2.54 mm Stift- und Buchsenleisten) (Spec, p. 2) (With English version of same dated Jul. 2007—(2.54 mm STL Pin Headers and Sockets).

* cited by examiner

*Primary Examiner*—Edwin A. Leon
(74) *Attorney, Agent, or Firm*—Collard & Roe, P.C.

(57) ABSTRACT

The invention relates to a plug-in connector (10*a*, 10*b*) comprising at least one contact element (12*a*, 12*b*), extending in a longitudinal direction (14*a*, 14*b*) of the plug-in connector, which in the fitted condition of the plug-in connector (10*a*, 10*b*) on a printed circuit board (38*a*, 38*b*) extends at least approximately in parallel to the plane (40*a*, 40*b*) of the circuit board (38*a*, 38*b*). The plug-in connector (10*a*, 10*b*) according to the invention is characterized in that the contact slot/the contact pin (28*a*, 28*b*) of the contact element (12*a*, 12*b*) has a predefined transverse extension (32*a*, 32*b*) in at least approximately the longitudinal direction (14*a*, 14*b*) of the plug-in connector and that the plug-in direction (34*a*, 34*b*) of the contact slot/contact pin (28*a*, 28*b*) is oriented at least approximately vertically to the plane (40*a*, 40*b*) of the circuit board (38*a*, 38*b*). Accordingly, a mating plug-in connector (10*a*, 10*b*) engages the plug-in connector (10*a*, 10*b*) laterally as it is mounted.

The plug-in connector (10*a*, 10*b*) according to the invention allows tolerances to be compensated between the printed circuit boards (38*a*, 38*b*) in the longitudinal direction (14*a*, 14*b*) of the plug-in connector, in the transverse direction (24*a*, 24*b*) of the plug-in connector and in the plug-in direction (34*a*, 34*b*). The plug-in connector according to the invention (10*a*, 10*b*) is suited especially for mezzanine applications.

12 Claims, 5 Drawing Sheets

A' - A''

B' - B''

C' - C''

D' - D''

PLUG-IN CONNECTOR

CROSS REFERENCE TO RELATED APPLICATIONS

Applicant claims priority under 35 U.S.C. §119 of German Application No. 10 2007 030 920.3 filed Jul. 3, 2007.

The present invention relates to a plug-in connector of the kind defined in the preamble of the independent claim.

Advances in the development of mobile electronic equipment, such as laptops, create an increasing demand for miniaturization of plug-in connectors. Such plug-in connectors are intended to connect printed circuit boards, arranged one above each other at least in part and approximately in parallel one to the other, in what is known as mezzanine applications which often need to have a high packing density. Still, high demands are placed on them regarding their current carrying capacity and also their thermal stability. Especially, high reliability remains a necessity which should be guaranteed even under circumstances where a mobile unit is exposed to high acceleration, for example by being dropped.

PRIOR ART

A plug-in connector for use in applications of small dimensions with high contact density and high contact numbers is described in DE 697 08 526 T2. The known plug-in connector comprises at least one lateral insulating supporting means, a central insulating supporting means and a conductive means. The conductive means comprises a first oblong section, fastened on the central insulating supporting means. Further, the conductive means contains a second oblong section, fastened to the lateral insulating supporting means. In addition, the conductive means contains an exposed third oblong section, arranged between the first oblong section and the second oblong section, so that in use the exposed third oblong section and the central insulating supporting means will extend together between the conductive means of a corresponding bushing.

DE 10 2005 028 512 A1 describes a plug-in connector having a housing, a first and a second connector element, at least one reinforcing brace and at least one flexible circuit. The first connector element may be arranged in a first opening of the housing, the second connector element in a second opening of the housing. The reinforcing brace may be placed upright in the housing. The first connector may accommodate a first end of the flexible circuit, while the second end of the flexible circuit is fitted between the reinforcing brace and the second connector.

A catalogue published by Applicant under Catalogue No. D 074570, 02/07, edition 1, offers an extensive portfolio of pinheaders some of which distinguish themselves by press-fit zones formed on both sides by stamping, especially for mezzanine applications. The plug-in connection is undetachable, robust, insensitive to vibrations and insensitive to contamination. For applications under extreme operating conditions the connector, including the press-fit zones, may be potted. Different spacings between the printed circuit boards arranged one above the other can be accommodated by different pin lengths. Additional insulating bodies stabilize the pinheaders if larger spacings exist between two printed circuit boards.

The known plug-in connectors have in common that the plugging-in operation always takes place in longitudinal direction of the contact element of the plug-in connector. In case a bend by a predefined angle, for example by 90 degrees, is envisaged that bend is realized by bending the contact elements of the plug-in connector correspondingly, for example in the connection area, in the fixing area or even in the contact-making area of the contact elements.

Now, it is the object of the invention to provide a plug-in connector having, especially, a small physical height.

That object is achieved by the features defined in the independent claim.

DISCLOSURE OF THE INVENTION

The plug-in connector according to the invention comprises at least one contact element, extending in a longitudinal direction of the plug-in connector, which in the fitted condition of the plug-in connector on a printed circuit board extends at least approximately in parallel to the plane of the circuit board. The plug-in connector according to the invention distinguishes itself by the fact that the contact slot or the contact pin, respectively, of the contact element has a predefined transverse extension in at least approximately the longitudinal direction of the plug-in connector and that the plug-in direction of the contact slot or the contact pin, respectively, is oriented at least approximately vertically to the plane of the circuit board. Thus, the plug-in direction likewise is oriented at least approximately vertically to the longitudinal direction of the plug-in connector.

Preferably, the plug-in connector according to the invention comprises a plurality of contact elements provided with either contact slots or contact pins or with mixed contact elements. The plug-in connector that mates the plug-in connector according to the invention is identical to the plug-in connector according to the invention with the exception that the contact elements comprise mating contact pins instead of the contact slots and mating contact slots instead of the contact pins, respectively.

Due to the special arrangement of the contact slots or the contact pins, respectively, which have their plug-in direction oriented substantially vertically to the longitudinal direction of the plug-in connector, the plug-in connector and the mating plug-in connector according to the invention are plugged in laterally.

The plug-in connector according to the invention allows an especially small height to be achieved, related to the plug-in direction, and is thus especially well suited for realizing plug-in connections between two printed circuit boards that are arranged one above the other, at least in part, in the assembled condition. The plug-in connector according to the invention is therefore especially well suited for mezzanine applications. The comparatively small physical height of the plug-in connector according to the invention allows a small spacing between two printed circuit boards and, accordingly, a small physical height of an electric unit to be achieved.

Although a small physical height of the plug-in connector according to the invention may be specified, the plug-in connector according to the invention ensures reliable contact-making, due to the freely selectable transverse extension of the contact slot or of the contact pin, respectively, while both high current loading and high thermal loading can be accommodated.

As a result of the configuration according to the invention the plug-in connector allows mechanical tolerance balancing in the longitudinal direction of the plug-in connector, in the transverse direction of the plug-in connector and in the plug-in direction substantially vertical to both the longitudinal direction of the plug-in connector and the transverse direction of the plug-in connector.

The plug-in connector according to the invention may be provided with a plurality of contact elements the number of which is limited only by the specified greatest width of the plug-in connector according to the invention in the transverse direction of the connector.

The mechanical and electric advantages of the plug-in connector according to the invention are achieved without any additional consumption of materials, compared with the plug-in connectors known from the prior art. This provides cost advantages especially in series production of the plug-in connector according to the invention.

Advantageous embodiments and further developments of the plug-in connector according to the invention will become apparent from the dependent claims.

According to one embodiment the contact element is arranged in a plug-in connector housing comprising a rear housing portion and a front housing portion that can be displaced one relative to the other in transverse direction of the plug-in connector, against the action of a spring. This feature permits high tolerances to be balanced out in transverse direction of the plug-in connector. The tension of the spring can be influenced simply by giving the plug-in connector housing a one-piece design and by connecting the front and the rear housing portions one with the other via a portion of reduced cross-section of the housing material.

According to another embodiment, the plug-in connector housing comprises clip receiving elements on the opposite sides in transverse direction of the plug-in connector, which are intended to receive and guide clips provided on the mating plug-in connector. This provides on the one hand reliable guidance to the mating plug-in connector during the plugging-in operation and, on the other hand, reliable fixing of the mating plug-in connector in the mounted condition.

A further development of that embodiment provides that at least one clip receiving element has at least one guide surface that tapers in the plug-in direction, for supporting the guiding effect for the clip of the mating plug-in connector during the fitting operation. Further, that guiding means has the effect that the mating plug-in connector will reliably slide into its final position in the fitted condition.

Correspondingly, one advantageous embodiment provides that the clips matching the clip receiving elements are formed on opposite sides of the plug-in connector housing, in transverse direction of the plug-in connector. That configuration leads to a C-shaped plug-in connector housing that embraces the mating plug-in connector housing in the form of a C in the fitted condition of the two plug-in connectors.

One further development of that embodiment provides again that the at least one clip on the forward end, viewed in the plug-in direction, comprises at least one tapering guide surface which likewise supports the guiding effect for the clip during the fitting operation and, in addition, causes the plug-in connector to slide reliably into its final position in the fitted condition.

One embodiment provides that the supporting surface in the clip receiving element or the entire plug-in connector housing and the supporting surfaces for the clips of the mating plug-in connector, are adjusted one relative to the other so that the plug-in connectors can be displaced one relative to the other by a predeterminable play in longitudinal direction, in the fitted condition of the plug-in connection. That feature allows the mechanical compensation of tolerances to be influenced purposefully.

According to one embodiment, the contact element comprises a compensating element. The compensating element is provided in the contact element of the plug-in connector between the rear and front housing portions which, according to one embodiment, are movable one relative to the other and allow a shearing movement in transverse direction of the plug-in connector. The compensating element, which may be bent in S shape, for example, contributes to the spring tension and supports the compensation of tolerances in transverse direction of the plug-in connector.

According to one further development, there is provided on the plug-in connector housing at least one locating element which enters a recess in the printed circuit board during assembly of the plug-in connector. The locating element facilitates the operation of mounting the plug-in connector according to the invention on the printed circuit board. Especially, there may be provided different embodiments of the locating elements, similar to a coding, so that the plug-in connectors cannot be mounted on the printed circuit board in an orientation other than the correct orientation.

An advantageous embodiment provides that the contact element comprises a flat terminal area, known as SMD solder terminal (Surface Mounting Device terminal). Connecting the plug-in connector according to the invention by soldering, by the SMD technique, not only provides a rational and, thus, low-cost way of soldering the plug-in connector, but also permits connections of printed circuit boards to be realized with good high frequency properties.

According to a further development of the plug-in connector according to the invention, separating elements are provided that are arranged between neighboring contact elements. The separating elements on the one hand provide the electric insulation between neighboring contact elements and on the other hand provide the means for guiding the contact elements of the mating plug-in connector during contact-making.

One embodiment provides that a contact spring of a contact element comprises two corresponding spring legs intended to receive a contact pin. Implementing the contact spring with two spring legs allows the lowest possible contact resistance to be achieved for the plug-in connection.

Advantageous further developments and embodiments of the plug-in connector according to the invention will become apparent from further claims.

Certain embodiments of the invention are illustrated in the drawing and will be discussed in more detail in the description that follows.

DRAWING

DETAILED DESCRIPTION OF THE EMBODIMENTS

Figure 1:
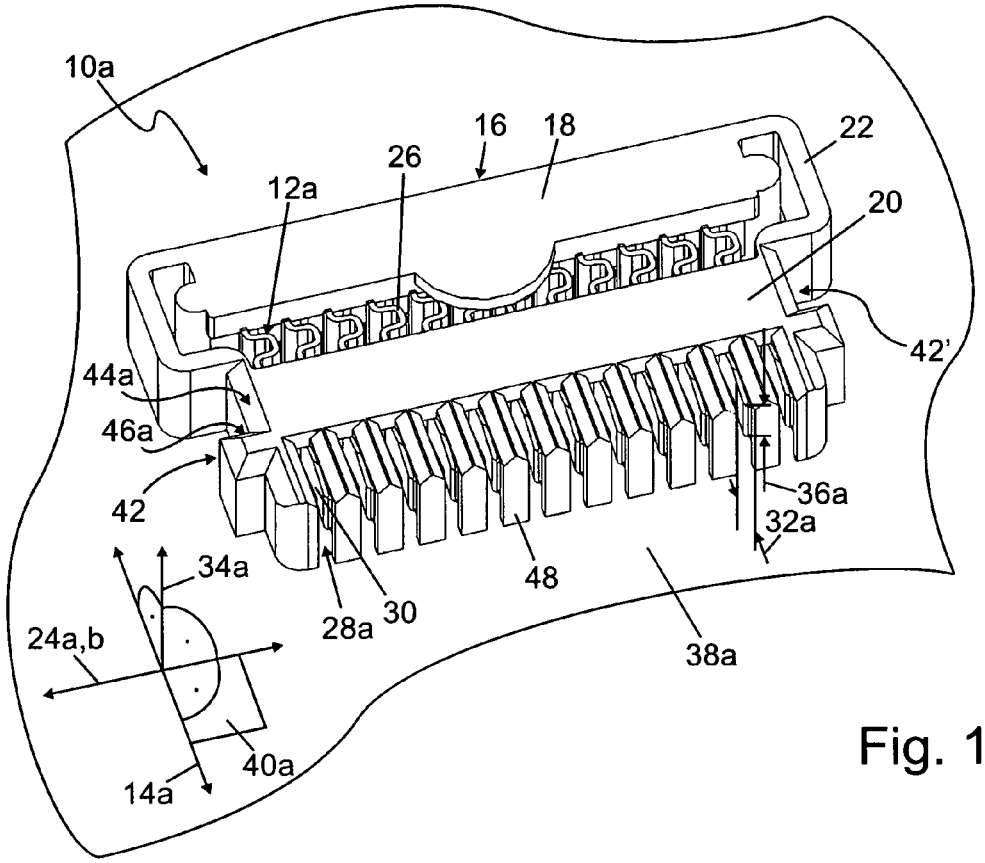
FIG. 1 shows a perspective view, especially of the top of the plug-in connector according to the invention.

FIG. 1 shows a perspective view, especially of the top of one embodiment of a plug-in connector 10*a* according to the invention. The plug-in connector 10*a* comprises at least one contact element 12*a*, the longitudinal direction of which extends in the longitudinal direction 14*a* of the plug-in connector. The plug-in connector 10*a* comprises a plug-in connector housing 16 consisting of a rear and a front housing portion 18, 20, respectively. The rear and the front housing portions 18, 20 are connected one with the other via a portion of reduced cross-section 22 of the material of the plug-in connector housing 16, the reduced cross-section 22 producing a first part of a spring tension between the rear and the front housing portions 18, 20 so that the two housing portions 18, are movable one relative to the other to a certain degree in the transverse direction 24*a* of the plug-in connector, allowing a shearing movement in the transverse direction 24*a* of the plug-in connector.

The contact element 12*a* is fixed on both the rear and the front housing portions 18, 20. The terminal area of the contact element 12*a*, which is not visible in FIG. 1, is formed on the rear housing portion 18. The mounting area of the contact element 12*a* is located in the front housing portion 20. The contact element 12*a* comprises a compensating element 26, provided between the rear and the front housing portions 18, 20, which is formed from the contact element 12*a* by an S-shaped bend of the contact element 12*a*, related to the longitudinal direction 14*a* of the plug-in connector. The compensating element 26 supports the shearing movement between the rear and the front housing portions 18, 20. The compensating element 26 and the reduced cross-section 22 between the rear and the front housing portions 18, 20 define together the spring tension produced by the shearing movement which, thus, can be predetermined in a defined manner.

The possibility for the front housing portion 20 to perform a shearing movement relative to the rear housing portion 18 of the plug-in connector 10*a* permits tolerances to be compensated both during connection to a mating plug-in connector, not shown in FIG. 1, and also in the assembled condition with the mating plug-in connector.

In the embodiment illustrated in FIG. 1, the contact element 12*a* comprises a contact slot 28*a* on its forward end, in the longitudinal direction 14*a* of the plug-in connector. The contact slot 28*a*, which may comprise a single spring leg 30, has a predefined transverse extension 32*a* in the longitudinal direction 14*a* of the plug-in connector, the transverse extension 32*a* of the contact slot 28*a* extending in the longitudinal direction 14*a* of the plug-in connector. The essential point is seen in the fact that, in contrast to known arrangements of plug-in connectors, the contact slot 28*a* instead of being contacted in the longitudinal direction 14*a* of the plug-in connector, is contacted by the corresponding contact pin, not shown in the drawing, vertically to the longitudinal direction 14*a* of the plug-in connector. Accordingly, the contact pin engages the contact slot 28*a* from the side, related to the longitudinal direction 14*a* of the plug-in connector. The transverse extension 32*a*, being oriented in the longitudinal direction 14*a* of the plug-in connector, therefore extends transversely to the plug-in direction 14*a* of the plug-in connector 10*a*.

The contact slot 28*a* further has a longitudinal extension 36*a*, in the plug-in direction 34*a* and vertically to the longitudinal direction 14*a* of the plug-in connector, that defines the possible contact area of the contact slot 28*a* in the plug-in direction 34*a*. Related to the transverse extension 32*a*, the amount of the longitudinal extension 36*a* may vary transversely to the plug-in direction 24*a*. Specifically, a tapering cross-section may be provided for the longitudinal extension 36*a*, in longitudinal direction 14*a* of the plug-in connector toward the front end of the plug-in connector 10*a*.

In the assembled condition, the plug-in connector 10*a* according to the invention is arranged on a first printed circuit board 38*a*, with the longitudinal direction 14*a* of the plug-in connector oriented at least approximately in parallel to the plane 40*a* of the first printed circuit board 38*a*. Due to the unique configuration of the plug-in connector 10*a* according to the invention, where the plug-in direction 34*a* extends substantially vertically to the longitudinal direction 14*a* of the plug-in connector, or vertically to the plane 40*a* of the first printed circuit board 38*a*, the plug-in connector 10*a* according to the invention is especially well suited for establishing connections between printed circuit boards 38*a*, 38*b*. Especially, the plug-in connector 10*a* according to the invention is particularly well suited for establishing connections between two printed circuit boards 38*a*, 38*b* the planes 40*a*, 40*b* of which extend substantially in parallel one to the other. The printed circuit boards 40*a*, 40*b* may overlap in this case in part only or else completely. The plug-in connector 10*a* according to the invention can therefore be used with particular advantage in so-called mezzanine applications.

The physical height of the plug-in connector 10*a* according to the invention can be kept relatively small. The physical height of the plug-in connector 10*a*, extending substantially vertically to the plane 40*a* of the first printed circuit board 38*a* in the plug-in direction 34*a*, can be determined especially by predefining the longitudinal extension 36*a* of the at least one spring leg 30 of the contact slot 28*a*. The longitudinal extension 36*a* allows tolerances between two plug-in connectors to be compensated in the plug-in direction 34*a* because the corresponding contact pin enters the contact slot 28*a* in the plug-in direction 34*a* to a lesser or greater degree.

Due to the transverse extension 32*a* of the at least one spring leg 30 of the contact slot 28*a*, the plug-in connector 10*a* according to the invention allows tolerances between the plug-in connector 10*a* and the mating plug-in connector, not shown in FIG. 1, to be further compensated in the longitudinal direction 14*a* of the plug-in connector.

All in all, the plug-in connector 10*a* according to the invention permits tolerances relative to a mating plug-in connector to be compensated in all directions in space, i.e. in the longitudinal direction 14*a* of the plug-in connector, the transverse direction 24*a* of the plug-in connector and in the plug-in direction 34*a*.

The front housing portion 20 of the plug-in connector 10*a* comprises clip receiving means 42, 42' intended to receive at least one clip of a mating plug-in connector not shown in FIG. 1. In order to facilitate the operation of pushing the clip into the clip receiving means 42, 42', there are provided a first guide surface 44*a* and a second guide surface 46*a* on the outer end of the front housing portion 20. The first guide surface 44*a* extends mainly in the longitudinal direction 14*a* of the plug-in connector whereas the second guide surface 46*a* extends in transverse direction 24*a* of the plug-in connector.

The number of contact elements 12*a* of the plug-in connector 10*a* may vary within wide limits. The number of the contact elements 12*a* to be arranged in the transverse direction 24*a* of the plug-in connector determines the width of the plug-in connector 10*a*. In order to insulate the individual contact elements 12*a* electrically one from the other, separating elements 48 are preferably provided, at least in the area of the contact slots 28*a*. The top of the separating elements 48 may comprise tapering portions, not shown in detail, especially in order to improve the guiding effect for the contact pins of the mating plug-in connector, which are not shown in FIG. 1.

Figure 2:
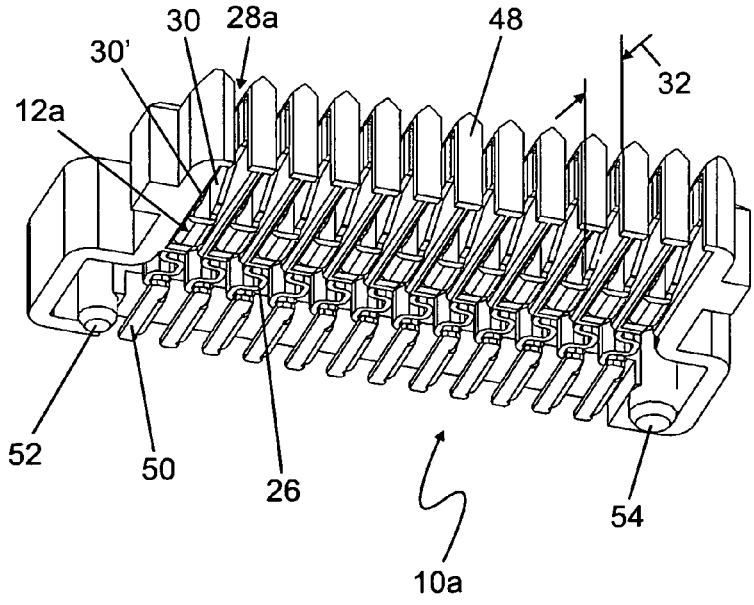
FIG. 2 shows a perspective view, especially of the bottom of the plug-in connector according to the invention.

FIG. 2 shows a perspective view especially of the bottom of the plug-in connector 10*a* according to the invention. Parts shown in FIG. 2 that are identical to parts illustrated in FIG. 1, are indicated by the same reference numerals. That convention applies to all Figures that follow.

FIG. 2 provides a view of the terminal face of the contact element 12*a*. The terminal face 50 is oriented substantially in parallel to the plane 40*a* of the first printed circuit board 38*a*. Specifically, the terminal face 50 is implemented as an SMD (Surface Mounting Devices) terminal face. From FIG. 2 it gets clear that the longitudinal extension 36*a* of the contact slot 28*a* may vary in the plug-in direction 34*a*, related to the longitudinal direction 14*a* of the plug-in connector. In the embodiment illustrated in the drawing, a reduction of the longitudinal extension 36*a* toward the front end of the plug-in connector 10*a* is envisaged.

FIG. 2 further provides a view of a first and a second locating element 52, 54. The two locating elements 52, 54 are configured for example as pins of circular cross-section, and the pins 52, 54 may have different diameters. Both locating elements 52, 54 are arranged on the rear housing portion 18 of the plug-in connector 10*a* for fixing the plug-in connector 10*a* on the first printed circuit board 38*a* before the at least one terminal face 50 is soldered to a conductor structure of the first printed circuit board 38*a*. The possibility to give the pins different diameters provides sort of a coding which guarantees correct locating of the plug-in connector 10*a* as the latter is mounted on the printed circuit board 38*a*.

FIG. 2 shows one embodiment of the contact slot 28*a* where the slot 28*a* comprises a second spring leg 30' in addition to the first spring leg 30.

Figure 3:
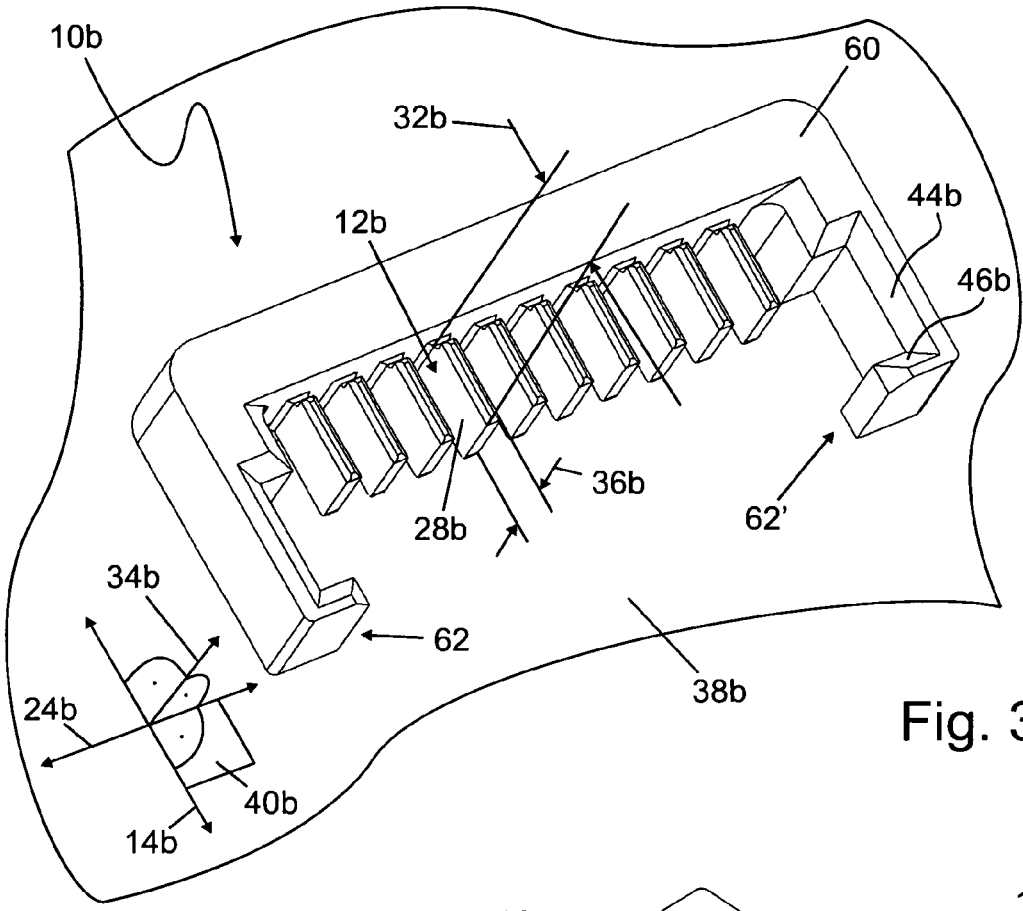
FIG. 3 shows a perspective view, especially of the top of a mating plug-in connector according to the invention.

FIG. 3 shows a perspective view especially of the top of a mating plug-in connector 10*b* matching the plug-in connector 10*a*. The mating plug-in connector 10*b* serves to establish connections between the first printed circuit board 38*a* and the second printed circuit board 38*b*, in which case the second printed circuit board 38*b* may be arranged especially at a small spacing from the first printed circuit board 30*a* and, especially, at least approximately in parallel to the first printed circuit board 38*a*, in the mounted condition of the two plug-in connectors 10*a*, 10*b*.

The longitudinal direction 14*b* of the mating plug-in connector 10*b* extends likewise in parallel, at least approximately, to the plane 40*b* of the second printed circuit board 38*b*. The plug-in direction 34*b* of the mating plug-in connector 10*b* extends again at least approximately vertically to the plane 40*b* of the second printed circuit board 38*b*.

The mating plug-in connector 10*b* comprises the mating contact element 12*b* that matches the at least one contact element 12*a* of the plug-in connector 10*a*. In the illustrated embodiment, the contact element 12*b* of the mating plug-in connector 10*b* is configured as a contact pin 28*b* matching the contact slot 28*a* of the plug-in connector 10*a*. The contact pin 28*b* likewise has a predefined transverse extension 32*b* in the plug-in direction 34*b* of the mating plug-in connector 10*b*. The transverse extension 32*b* and the longitudinal extension 36*b* of the contact pin 28*b*, in combination with the transverse extension 32*a* and the longitudinal extension 36*a* of the contact slot 28*a* of the plug-in connector 10*a*, allow tolerances between the two plug-in connectors 10*a*, 10*b* to be compensated in the mounted condition, both in the longitudinal direction 14*a*, 14*b* of the plug-in connectors and also in the plug-in direction 34*a*, 34*b*.

The plug-in connector housing 60 of the mating plug-in connector 10*b* has a C-shaped configuration. On the front end of the mating plug-in connector 10*b* there are provided clips 62, 62' intended to engage the clip receiving means 42, 42' of the plug-in connector 10*a* during the mounting operation and to lock the two plug-in connectors 10*a*, 10*b* one relative to the other in the longitudinal direction 10*a*, 10*b* of the plug-in connector, in the engaged condition of the plug-in connectors 10*a*, 10*b*. Preferably, the clips 62, 62' are provided, on their front ends, with at least one guide surface 44*b*, 46*b* that corresponds to the guide surface 44*a*, 46*b* of the plug-in connector 10*a*.

The number of contact elements 12*b* of the mating plug-in connector 10*b* is identical to the number of contact elements 12*a* of the plug-in connector 10*a*. The number of contact elements 12*b* determines the width of the mating plug-in connector 10*b* in the transverse direction 24*b* of the plug-in connector.

Preferably tapering portions, not indicated in detail, are provided on the contact pins 28*b* of the mating plug-in connector 10*b* in order to facilitate the introduction of the contact pins 28*b* into the mating contact slots 28*a* during the plug-in operation.

Figure 4:
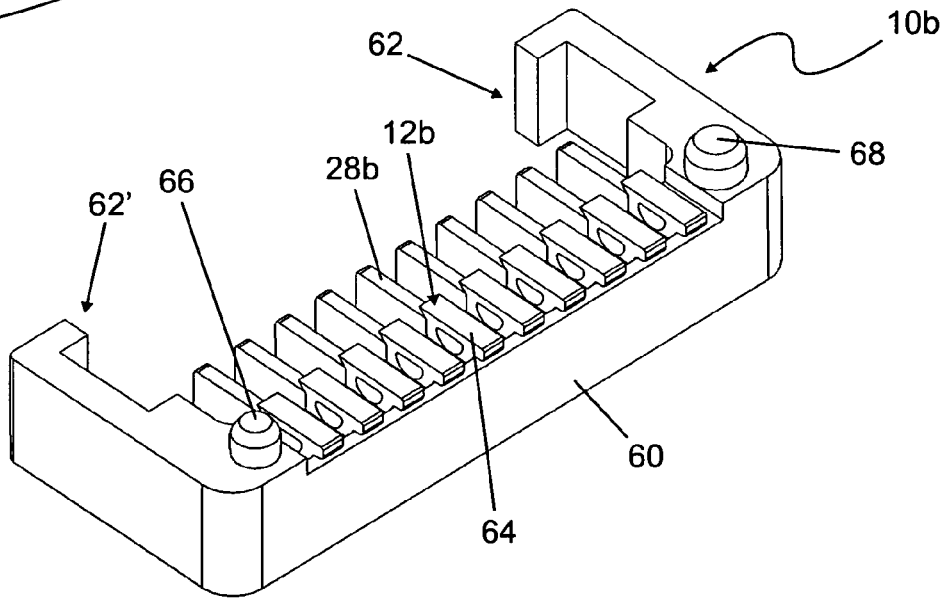
FIG. 4 shows a perspective view, especially of the bottom of a mating plug-in connector according to the invention.

FIG. 4 shows a perspective view especially of the bottom of the mating plug-in connector 10*b*. FIG. 4 gives a view of a terminal face 64 of the contact element 12*b* of the mating plug-in connector 10*b*, which preferably is orientated substantially in parallel to the plane 40*b* of the second printed circuit board 38*b*, in the assembled condition of the mating plug-in connector 10*b*. Preferably, the terminal face 64 is again implemented as an SMD terminal face 64.

FIG. 4 further provides a view of the first and the second locating elements 66, 68 of the mating plug-in connector 10*b*. Preferably, the two locating elements 66, 68 have again a circular cross-section, and the diameters of the two locating elements 66, 68 may again be different. As the mating plug-in connector 10*b* is mounted, the locating elements 66, 68 again come to engage corresponding recesses in the second plug-in connector 38*b*, thereby fixing the mating plug-in connector 10*b* before the latter is soldered to the conductor structure of the second plug-in connector 38*b*.

Figure 5:
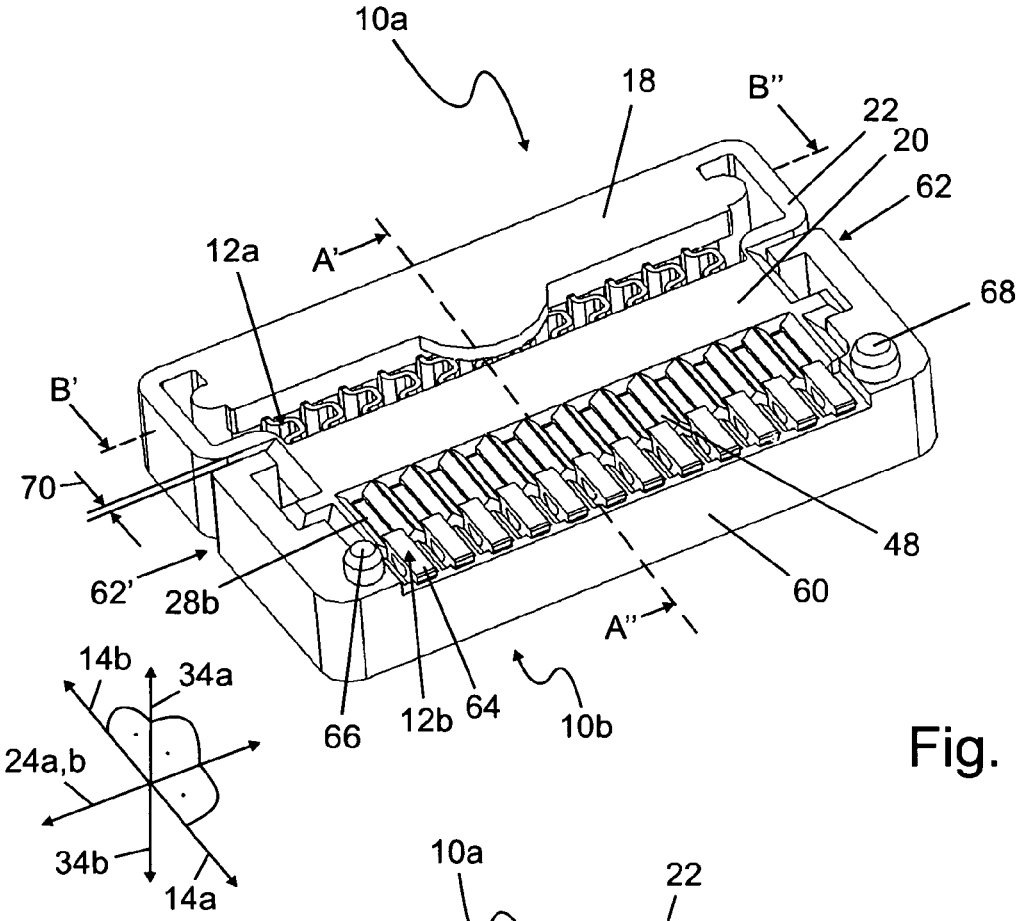
FIG. 5 shows a perspective view, especially of the top of the plug-in connector according to the invention and of the bottom of the mating plug-in connector according to the invention, in mounted condition.

FIG. 5 shows a perspective view especially of the top of the plug-in connector 10*a* according to the invention and of the bottom of the mating plug-in connector 10*b* according to the invention, in mounted condition. Reference numeral 70 in FIG. 5 indicates a play in longitudinal direction by which the mating plug-in connector 10*b* can balance out tolerances relative to the plug-in connector 10*a* in the longitudinal direction 14*a*, 14*b* of the plug-in connector. This is achieved by adapting the contact surfaces, not indicated in detail, of the clip receiving means 42, 42' of the plug-in connector 10*a* and the contact surfaces of the clips 62, 62' of the mating plug-in connector 10*b* one relative to the other in a way that will ensure that a predefined play 70 in longitudinal direction is provided in the mounted condition of the plug-in connectors 10, 10*b*.

Figure 6:
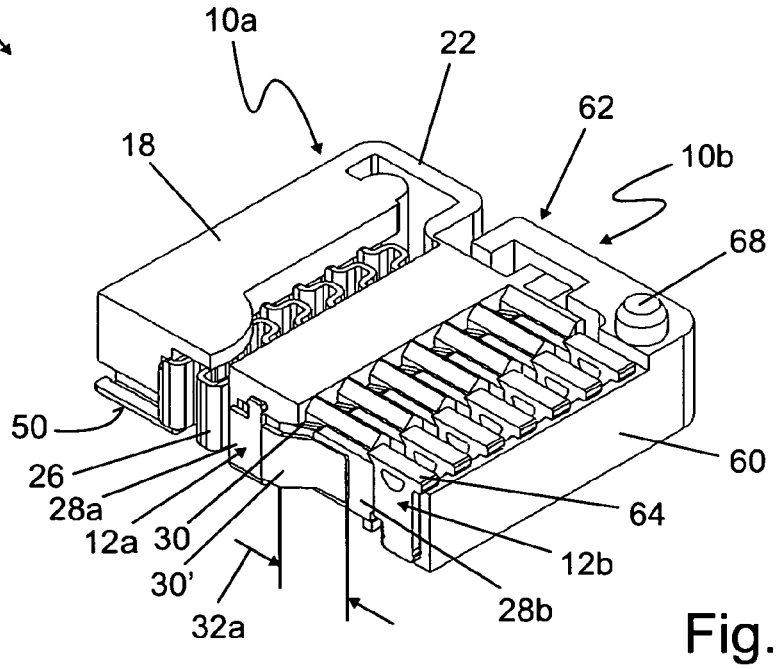
FIG. 6 shows a sectional perspective view of the arrangement illustrated in FIG. 5, taken along a line in the longitudinal direction of the plug-in connector.

FIG. 6 shows a perspective view of the arrangement of FIG. 5, sectioned along a line A'-A" extending in the longitudinal direction 14*a*, 14*b* of the plug-in connector. The sectional view only shows a section through the housing 16 of the plug-in connector 10*a* and the housing 60 of the mating plug-in connector 10*b*. The sectional illustration also provides a view of the contact elements 10*a*, 10*b*, which are not sectioned in the drawing.

FIG. 6 shows the arrangement of the contact pin 28*b* in the contact slot 28*a* in the mounted condition of the plug-in connection. FIG. 6 clearly explains the possibility to compensate tolerances between the plug-in connectors 10*a*, 10*b* both in the longitudinal direction 14*a*, 14*b* of the plug-in connector, where they are due to the transverse extension 32*a* of the contact slot 28*a*, and in the transverse direction 32*b* of the contact pin 28*b*, not shown in the drawing, and also in the plug-in direction 34*a*, 34*b*, where they are due to the longitudinal extension 36*a*, not indicated in the drawing, of the contact slot 28*a* and the longitudinal extension 36*b*, not indicated in the drawing, of the contact pin 28*b*.

Compensation of tolerances in the longitudinal direction 14*a*, 14*b* of the plug-in connector is rendered possible by the predeterminable play 70 in longitudinal direction. Compensation of tolerances in the plug-in direction 34*a*, 34*b* is rendered possible by the fact that the contact pin 28*b* enters the contact slot 28*a* in the plug-in direction 34*a*, 34*b* by a greater of lesser degree. Compensation of tolerances between the two printed circuit boards 38*a*, 38*b* is ensured by a shearing movement allowed between the rear and the front housing portions 18, 20 of the plug-in connector 10*a* and, thus, between the two plug-in connectors 10*a*, 10*b* in the mounted condition.

Figure 7:
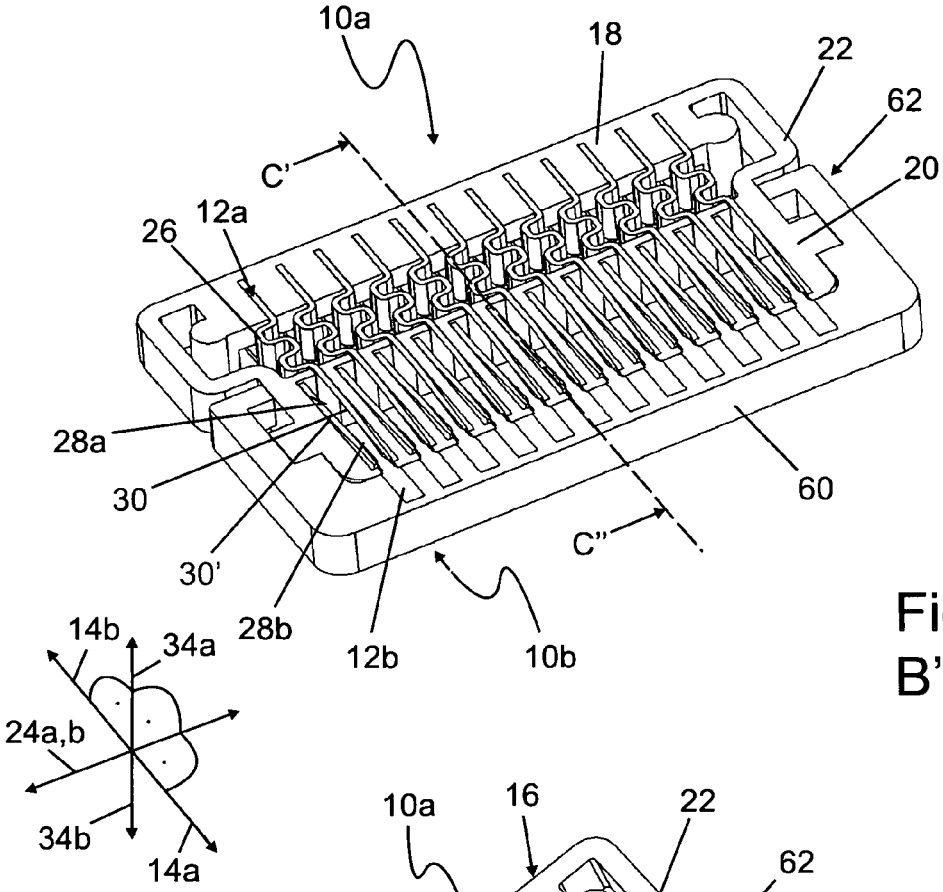
FIG. 7 shows a sectional perspective view of the arrangement illustrated in FIG. 5, taken along a line in transverse direction of the plug-in connector.

FIG. 7 shows a perspective view of the arrangement illustrated in FIG. 5, sectioned along line B'-B". FIG. 7 illustrates the way in which the contact element 12*a* is fixed in the rear housing portion 18 as well as in the front housing portion 20 of the plug-in connector 10*a*, with the compensating element 26 arranged between the fixing points. Further, FIG. 7 shows a favorable embodiment of the contact slot 28*a* and/or the contact pin 28*b*. The at least one spring leg 30, 30' of the contact slot 28*a* is bent, in the longitudinal direction 14*a*, 14*b* of the plug-in connector, in transverse direction 24*a*, 24*b* of the plug-in connector toward the forward end of the plug-in connector 10*a*, in such a way that a contact pressure depending on the particular position is provided to the contact pin 28*b* in response to the degree of overlapping with the contact slot 28*b* in transverse direction 36*a*, 36*b*. Correspondingly, the contact pin 28*b* may be given a configuration such that the extension in transverse direction 24*a*, 24*b* of the plug-in connector will vary relative to the longitudinal direction 14*b* of the mating plug-in connector 10*b*, and will accordingly rise in the illustrated embodiment.

Figure 8:
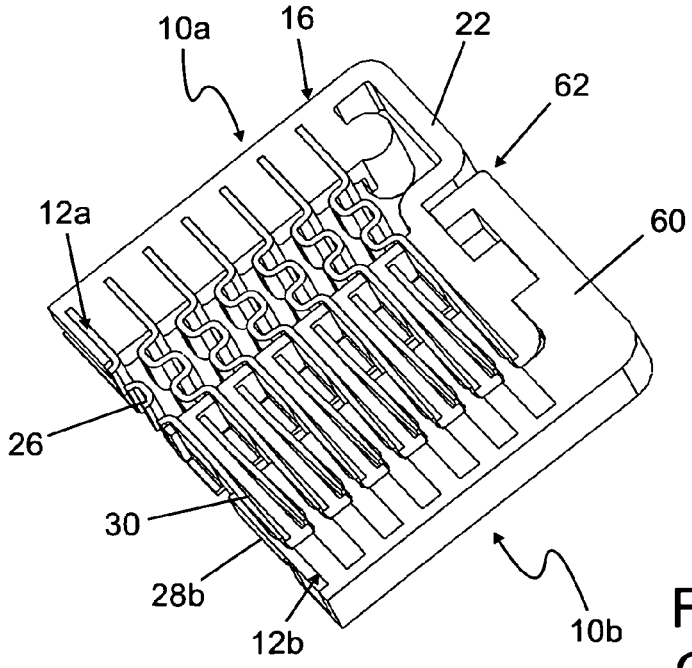
FIG. 8 shows a perspective view of the arrangement illustrated in FIG. 7, additionally sectioned along a line in transverse direction of the plug-in connector.

FIG. 8 shows a perspective view of the arrangement illustrated in FIG. 7, sectioned additionally along a line C'-C" extending in transverse direction 24*a*, 24*b* of the plug-in connector. That illustration shows a sectional view not only of the connector housing 16, 60, but also of the contact element 12*a* of the plug-in connector 10*a* and of the contact element 12*b* of the mating plug-in connector 10*b*. FIG. 8 illustrates additionally the arrangement of the contact pin 28*b* relative to the one spring leg 30.

Figure 9:
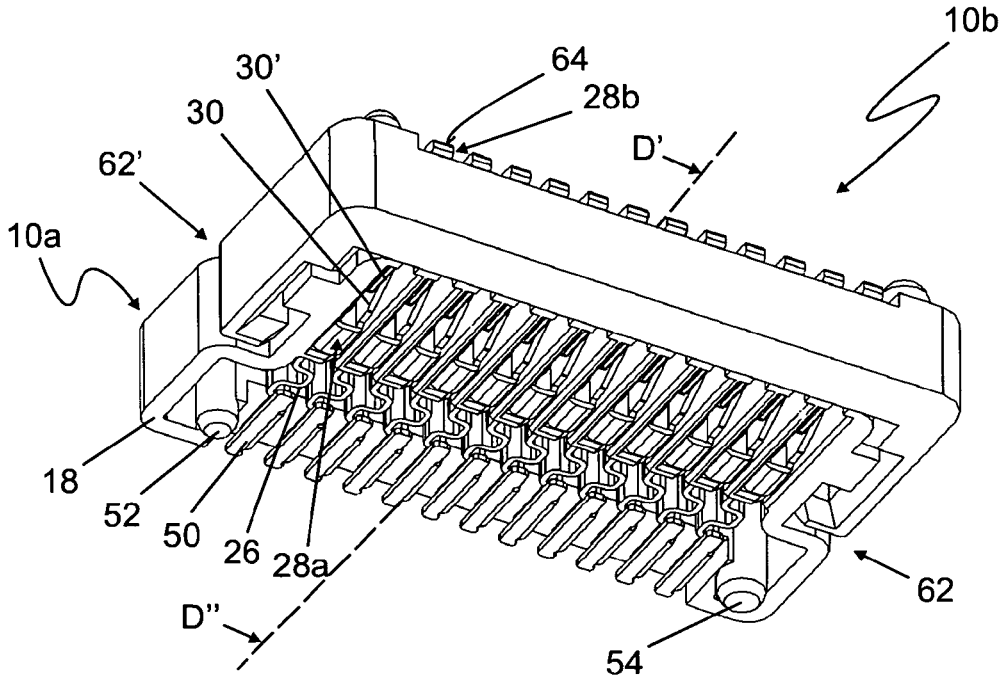
FIG. 9 shows a perspective view, especially of the bottom of the plug-in connector according to the invention and of the top of the mating plug-in connector according to the invention, in mounted condition.
Figure 10:
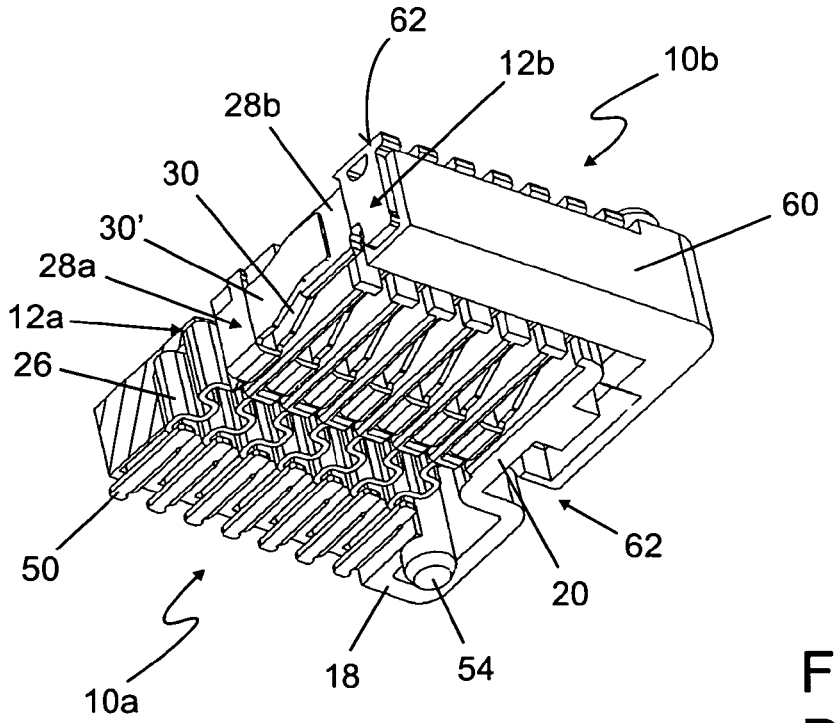
FIG. 10 shows a perspective view of the arrangement illustrated in FIG. 9, sectioned along a line in longitudinal direction of the plug-in connector.

FIG. 9 shows a perspective view especially of the bottom of the plug-in connector 10*a* according to the invention and of the top of the mating plug-in connector 10*b* according to the invention, in mounted condition, while FIG. 10 shows a perspective view of the arrangement illustrated in FIG. 9, sectioned along line D'-D" in the longitudinal direction 14*a*, 14*b* of the plug-in connector, except for the contact elements 12*a*, 12*b* which are not sectioned. FIGS. 9 and 10 further illustrate the arrangement and the locations of the plug-in connectors 10*a*, 10*b* and of their components, in the mounted condition.

The invention claimed is:

1. Plug-in connector comprising at least one contact element (12*a*, 12*b*) having a contact selected from the group consisting of a contact slot and a contact pin, said at least one contact element extending in a longitudinal direction (14*a*, 14*b*) of the plug-in connector, which in the fitted condition of the plug-in connector (10*a*, 10*b*) on a printed circuit board (38*a*, 38*b*) extends at least approximately in parallel to the plane (40*a*, 40*b*) of the circuit board (38*a*, 38*b*), wherein the contact of the contact element (12*a*, 12*b*) has a predefined transverse extension (32*a*, 32*b*) in at least approximately the longitudinal direction (14*a*, 14*b*) of the plug-in connector and wherein the plug-in direction of the contact is oriented at least approximately vertically to the plane (40*a*, 40*b*) of the circuit board (38*a*, 38*b*);

wherein the contact element (12*a*) of the plug-in connector (10*a*) is arranged in a plug-in connector housing (16), which comprises a rear housing portion (18) and a front housing portion (20) that is displaceable one relative to the other in transverse direction (24*a*) of the plug-in connector, against the action of a compensating element;

wherein the contact element (12*a*) of the plug-in connector (10*a*) comprises the compensating element (26);

wherein the compensating element (26) is bent relative to the longitudinal direction (14*a*) of the plug-in connector, and the compensating element supporting a shearing movement between the rear and front housing portions.

2. The plug-in connector as defined in claim 1, wherein at least one locating element (52, 54, 66, 68) is provided which is positioned in a mating recess of the printed circuit board (38*a*, 38*b*) in the assembled condition of the plug-in connector (10*a*, 10*b*).

3. The plug-in connector as defined in claim 1, wherein the contact element (12*a*, 12*b*) comprises a terminal face (50, 64) oriented substantially in parallel to the plane (40*a*, 40*b*) of the plug-in connector (38*a*, 38*b*).

4. The plug-in connector as defined in claim 1, wherein separating elements (48) are arranged between neighboring contacts.

5. The plug-in connector as defined in claim 1, wherein the contact element (12*a*) comprises two spring legs (30, 30') mating each other and receiving a contact pin (28*b*).

6. The plug-in connector as defined in claim 1, wherein the compensating element (26) is bent in S shape.

7. The plug-in connector as defined in claim 1, wherein the connector housing (16) has a one-piece design and wherein the spring tension is influenced by a portion of reduced cross-section (22) of the housing material of the plug-in connector between the forward and the rear portions (18, 20) of the housing.

8. The plug-in connector as defined in claim 7, wherein the clip receiving means (42, 42') and the clips (62, 62') of the mating plug-in connector (10*b*) are adapted one to the other in such a way that, in the mounted condition of the plug-in connector (10*a*, 10*b*), both plug-in connectors (10*a*, 10*b*) can be displaced one relative to the other in the longitudinal direction (14*a*, 14*b*) of the plug-in connector by a play (70) in the longitudinal direction.

9. The plug-in connector as defined in claim 1, wherein the plug-in connector housing (16) comprises clip receiving elements (42, 42') on the opposite sides in transverse direction (24*a*) of the plug-in connector, which receive and guide clips (62, 62') of a plug-in connector (10*b*) mating the plug-in connector (10*a*).

10. The plug-in connector as defined in claim 9, wherein at least one clip receiving element (42, 42') has at least one guide surface (44*a*, 46*a*) that tapers in the plug-in direction (34*a*) of the plug-in connector (10*a*).

11. The plug-in connector as defined in claim 9, wherein the plug-in connector housing (60) of the mating plug-in connector (10*b*) is provided, on the opposite sides in transverse direction of the plug-in connector, with clips (62, 62') corresponding to the clip receiving elements (42, 42') and embracing the plug-in connector (10*a*) in C shape.

12. The plug-in connector as defined in claim 11, wherein at least one clip (62, 62') is provided on its forward end, relative to the plug-in direction (34*b*), with at least one tapering mating guide surface (44*b*, 46*b*).

* * * * *